United States Patent [19]

Holmes

[11] Patent Number: 4,484,847

[45] Date of Patent: Nov. 27, 1984

[54] CARGO CONTROL TRACK AND FITTING

[75] Inventor: Paul M. Holmes, Jackson, Mich.

[73] Assignee: Aeroquip Corporation, Jackson, Mich.

[21] Appl. No.: 392,545

[22] Filed: Jun. 28, 1982

[51] Int. Cl.[3] ..... B61D 45/00; B60P 7/08

[52] U.S. Cl. ..... 410/104; 24/265 R; 24/572; 410/115

[58] Field of Search ..... 410/101, 104, 105, 116, 410/130, 150, 108, 112-115, 100, 103, 21, 85, 156; 24/265 R, 69 R, 205 R, 201 HH, 201 R, 201 A, 572, 575, 584

[56] References Cited

U.S. PATENT DOCUMENTS

| | | | |
|---|---|---|---|
| 2,891,490 | 6/1959 | Elsner | 410/105 |
| 2,984,885 | 5/1961 | Elsner | 24/265 R |
| 3,017,679 | 1/1962 | Elsner | 24/201 HH |
| 3,422,508 | 1/1969 | Higuchi | 410/105 |

*Primary Examiner*—Randolph Reese

*Attorney, Agent, or Firm*—Beaman & Beaman

[57] ABSTRACT

The invention pertains to a cargo control tack and a fitting for use therewith wherein the fitting is captive to the track. The track is of a generally U configuration having a base attached to a surface of a cargo compartment, parallel legs extend from the base, and the legs terminate in outwardly extending flanges disposed parallel to the base. Aligned notches or indentations are defined within the track at the intersection of the legs and flanges. The fitting is associated with a strap loop, and includes a pair of side plates having a keeper plate located therebetween. The side plates slidably hook upon the track flanges, and the keeper plate is forced into a locking relationship with the track indentations by tension within the strap to fix the fitting upon the track. The flexibility of the strap loop permits the keeper plate to be disengaged from the track notches for adjustment of the fitting along the track.

9 Claims, 5 Drawing Figures

CARGO CONTROL TRACK AND FITTING

BACKGROUND OF THE INVENTION

Cargo control tracks are commonly mounted upon the wall or floor of cargo compartments of trucks, vans, boxcars, aircraft, and the like, and fittings to which straps are affixed cooperate with the track to bind cargo and prevent shifting thereof within the compartment. Usually, the fittings are removable from the track by various types of release features, and typical fittings of this type are shown in U.S. Pat. Nos. 2,984,885 and 3,017,679.

With fittings which releasably attach to the track there is frequent loss or damage of the fittings and associated strap due to carelessness and in many applications there is the need for a captive fitting which cannot be released from the associated cargo control track, but which may be readily located upon the track.

Heretofore, captive fittings have not been satisfactory due to excessive costs of the track or fitting, and the desired simplicity of construction, function and operation has not heretofore been achieved.

It is an object of the invention to provide a cargo control track with a captive fitting which is of very economical manufacture, yet is dependable in operation and readily operated by one hand.

Another object of the invention is to provide a cargo control track with a captive fitting wherein the track is of an economical construction, and may be readily formed by high production fabrication techniques.

A further object of the invention is to provide a cargo control track with a captive fitting wherein the fitting consists of three stamped metal plate members, two of which are identical, and each of the plate members is associated with a strap loop, the tension within the strap loop when under load producing a locking action which prevents movement of the fitting relative to the track.

Yet another object of the invention is to provide a captive fitting for a cargo control track wherein locking of the fitting to the track is achieved by the tension within the strap with which the fitting is associated.

An additional object of the invention is to provide a captive fitting for use with a flexible strap loop wherein the fitting is lockable to a control track and releasable therefrom, releasing being accomplished by the deformation of the strap loop material.

In the practice of the invention the cargo control track is of a U-shaped configuration having a base which is mounted upon the cargo compartment wall, or may be recessed within the compartment floor. The track includes parallel legs extending from the base, and flanges outwardly project from the ends of the legs in spaced parallel relationship to the track base. Aligned notches are defined in the track adjacent the intersection of the legs and associated flanges, and these notches may constitute openings, or indentations.

The three fitting components are stamped sheet metal plates mounted upon a loop in the load restraining strap. Two of the fitting plates constitute side plates of identical construction each having hook portions which extend over the track flanges. The third plate comprises a keeper located intermediate the side plates, and as with the side plates, includes a strap loop receiving opening or slot. The keeper includes a projection which aligns with the track notches, and is forced into the notches by tension within the strap loop. Accordingly, the strap is fixed to a predetermined location of the track when in use.

Upon release of the strap loop tension the keeper plate may be readily removed from the track notches by pulling the keeper away from the track. This action separates the side plates, permitting the strap loop to deform, and with the keeper removed from the track the fitting side plates may slide along the track for relocation as desired.

When the cargo control equipment is not in use, merely the weight of the strap is sufficient to force the keeper into engagement with a track notch and prevent undesirable movement of the fitting upon the track even though no tension is within the strap.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
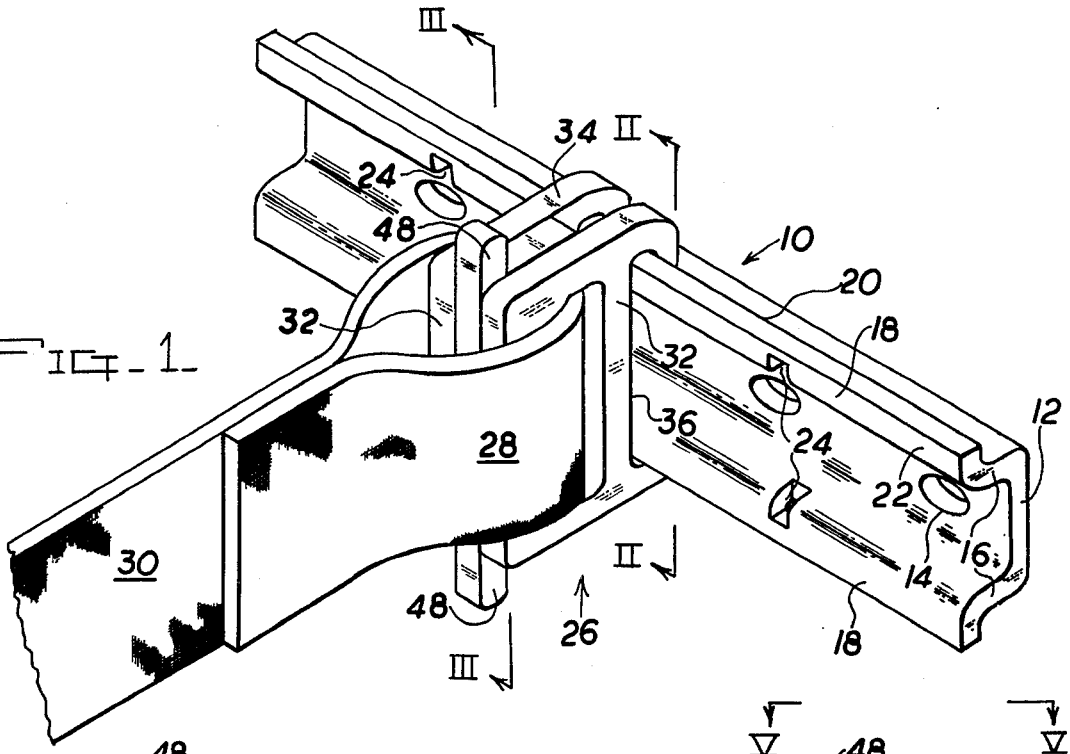
FIG. 1 is a perspective view of a cargo control track and captive fitting in accord with the invention.
Figure 2:
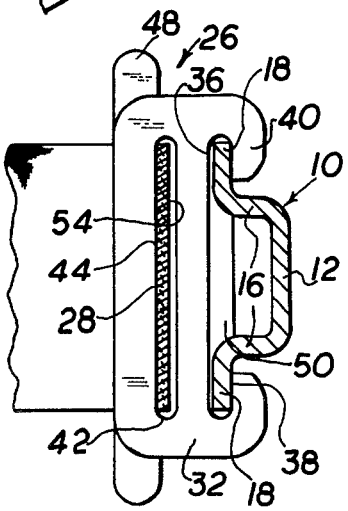
FIG. 2 is an elevational sectional view as taken along Section II—II of FIG. 1.

The cargo control track configuration in accord with the invention will be readily appreciated from FIGS. 1 and 2. Basically, the track 10 is of a U configuration having a flat base 12, and holes 14 are defined within the base at spaced intervals along the track length for attaching the track to a supporting wall, floor, or the like, by screws or bolts. A pair of parallel legs 16 extend from the base, and each of the legs is provided with an outwardly extending flange 18. The flanges are coplanar, include an inner surface 20 and an outer surface 22 and are preferably parallel to the base 10. At equally spaced intervals along the track a pair of aligned notches 24 are formed in the outer surface 22 of the flanges at the intersection of the legs and their associated flange. In the illustrated embodiment these aligned notches are in the form of openings which have been stamped into the track prior to formation by rolling. However, the notches need not be openings, but may constitute indentations in the track at the indicated locations. The notches in the flanges are opposed to each other, aligned opposed notches lying in a plane perpendicular to the track length.

The fitting 26 is for use with cargo control apparatus employing flexible straps or webbing, as is widely used, and the fitting is located within a loop 28 formed at the end of the strap 30. Means for tensioning the strap 30 are usually associated therewith, such tensioning devices may take the form of a buckle, winch, or other known tensioner, not shown.

The fitting 26 consists of three flat sheet metal components. These components include two identical side plates 32, and a keeper plate 34 located therebetween. The configuration of the side plates is best appreciated from FIGS. 1 and 2, and includes an elongated track receiving recess 36 consisting of notches 38 defined by hooked portions 40. Additionally, the side plates each include an elongated opening 42 through which the strap loop 28 passes. As apparent in the drawings, the track flanges 18 are received within the side plate notches 38 wherein the hooks 40 overlap the flanges for engagement with surface 20, and sufficient clearance exists within the side plate notches to permit the fitting to readily slide along the track flanges.

Figure 3:
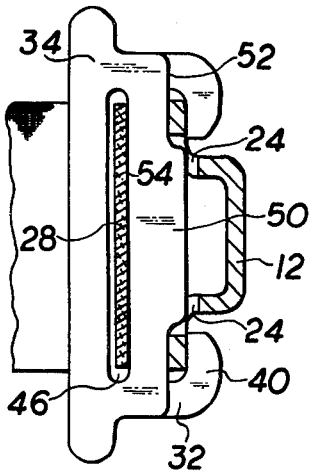
FIG. 3 is an elevational sectional view illustrating the keeper in the locked position as taken along Section III—III of FIG. 1.

The configuration of the keeper plate 34 is as shown in FIG. 3. The keeper includes an elongated opening 46 which receives the strap loop 28, and ears 48 extend from the ends of the keeper plate beyond the side plates 32 wherein the ears may be readily grasped to manipulate the keeper for fitting release purposes. The edge 44 of the openings 42 is designated the tension edge and this edge is remote from recess 36 and is engaged by the loop 28 when the strap 30 is under tension. The keeper also includes a projection 50 extending from the keeper inner side 52, and this projection is of such configuration as to be readily received within the track notches 24 when aligned therewith. The opening 46 includes a tension edge 54 disposed toward projection 50 which engages loop 28 when the strap is tensioned.

The openings 42 of the side plates 32 and the loop opening 46 of the keeper plate 34 are substantially aligned but are so related to each other so that a slight offset occurs so that when the strap loop 28 is under tension, the components of the fitting will be related as shown in FIGS. 2 and 3. The strap loop openings 42 within the side plates are located such that when the tension within the strap loop 28 causes the strap loop to engage the side plate opening edges 44 the strap loop will engage the keeper opening edge 54 and the loop tension causes the strap loop to firmly engage the keeper opening edge 54 forcing the keeper projection 50 into the track notches 24. The greater the tension within the strap 30, the greater the biasing force of the keeper into the notches. However, it is to be appreciated that the relationship of the strap loop openings of the side plates and keeper is not such as to shear or cut the strap loop as the degree of offset between openings 42 and 46 is approximately equal to the strap thickness.

Figure 4:
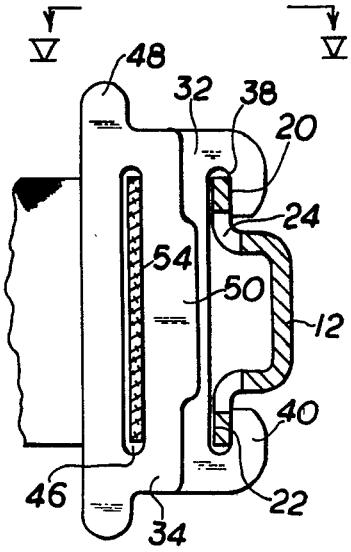
FIG. 4 is an elevational sectional view similar to FIG. 3 illustrating the keeper in the release position.
Figure 5:
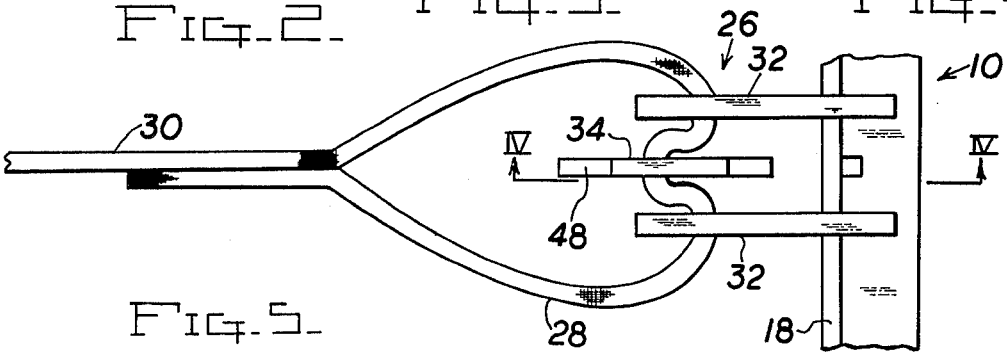
FIG. 5 is a top plan view of the relationship of the components as shown in FIG. 4 along Section V—V thereof.

To release the fitting 26 from the control track 10, the tension within strap 30 must be released. Thereupon, the keeper ears 48 are grasped by the operator's fingers, and the keeper plate is pulled in a direction away from track 10. Due to the release of the strap loop tension, such a force exerted upon the keeper causes the flexible strap loop to deform, separating the side plates 32, and permitting the keeper projection 50 to be removed from the notches 24, as shown in FIGS. 4 and 5. With the keeper removed from the track notches, the fitting and strap loop may be easily moved along the track for relocation as desired. The keeper is then aligned with the desired set of notches 24, and merely releasing the keeper will permit the weight of the strap to bias the keeper toward the track and engagement with the aligned notches. Thus, engagement of the keeper with the notches even when the apparatus is not in use occurs, and movement of the fitting along the track due to acceleration or deceleration of the cargo vehicle will not cause significant movement of the fitting on the track. In fact, even with the keeper plate not in alignment with notches 24 the weight of the strap biasing the keeper projection into engagement with the track will produce sufficient frictional engagement between the fitting and track to prevent most nonuse movement of the fitting on the track.

It will be appreciated from the foregoing description that a captive fitting for a cargo control track has been produced which is economical in construction and fabrication, simple and reliable in operation, and utilizes tension forces within the strap to lock the fitting to the track.

It is appreciated that various modifications to the inventive concepts may be apparent to those skilled in the art without departing from the spirit and scope of the invention.

I claim:

1. A cargo track and fitting system comprising, in combination, an elongated track including substantially parallel spaced flanges, each having a terminating edge, an outer surface and an inner surface, a flexible strap having a loop defined therein, a fitting mounted upon said loop, said fitting comprising a pair of side plates each having a loop receiving opening defined therein, a pair of hooks defined upon each side plate each extending over a track flange edge whereby tension within said strap forces said hooks against the associated flange inner surface, a keeper plate located between said side plates having a loop receiving opening defined therein, track engagable friction producing means defined upon said keeper plate, said keeper plate opening being related to said side plates openings such that tension within said loop tending to pull said side plates away from said track forces said keeper plate toward said track causing said friction producing means to engage said track.

2. In a cargo track and fitting system as in claim 1 said friction producing means comprising a projection defined upon said keeper plate extending toward said track.

3. In a cargo track and fitting system as in claim 2, at least one indentation defined in said track flanges outer surface, said projection adapted to be received within said indentation upon alignment therewith and tensioning of said strap.

4. In a cargo track and fitting system as in claim 3 wherein a pair of aligned indentations are defined in said track flanges outer surface, said projection having spaced corners defined thereon, said corners being received within said aligned indentations.

5. In a cargo track and fitting system as in claim 4, wherein said track includes a pair of spaced leg portions, said flanges being defined upon said leg portions, said indentations being defined upon said flanges outer surface at the intersection of said flanges with the associated leg portion.

6. In a cargo track and fitting system as in claim 2, a pair of spaced finger gripable extensions defined upon said keeper plate extending beyond the configuration of said side plates to permit manual manipulation of said keeper plate.

7. A captive cargo control fitting for mounting upon the loop of a flexible strap comprising in combination, a pair of side plates each having a pair of track engagable spaced hooks defined thereon defining an elongated track receiving recess, an elongated strap loop receiving opening defined in each side plate substantially parallel to the associated track receiving recess and having a tension edge disposed away from the track recess and engaged by the strap loop when the strap is under tension, a keeper plate located between said side plates having a track engagable surface in substantial alignment with said side plates' track receiving recesses and an elongated strap loop receiving opening substantially in alignment with said side plates loop receiving openings, said keeper plate loop receiving opening having a tension edge disposed toward its track engagable surface and so related to said side plates tension edges that tension within the strap loop forces said keeper plate in the direction of said track engagable surface.

8. In a captive cargo control fitting as in claim 7, said keeper plate having an elongated projection defined thereon substantially parallel to said keeper plate loop receiving opening, said track engagable surface being defined upon said projection.

9. In a captive cargo control fitting as in claim 8, a pair of spaced finger engagable tabs defined upon said keeper plate extending in opposite directions from said keeper plate and extending beyond the configuration of said side plates.

* * * * *